US005666839A

United States Patent [19]

Su et al.

[11] Patent Number: 5,666,839

[45] Date of Patent: Sep. 16, 1997

[54] REDUCTION OF FRICTION DURING WIRE DRAWING

[75] Inventors: Yea-Yang Su, Marietta; Miroslav I. Marek, Atlanta, both of Ga.; Ming Chien Hung, Chungli, Taiwan

[73] Assignee: Georgia Tech Research Corporation, Atlanta, Ga.

[21] Appl. No.: 558,615

[22] Filed: Nov. 14, 1995

Related U.S. Application Data

[63] Continuation of Ser. No. 199,850, Feb. 22, 1994, abandoned.

[51] Int. Cl.[6] ..... B21B 45/02

[52] U.S. Cl. ..... 72/43; 72/41

[58] Field of Search ..... 72/39, 41, 43, 72/44, 45, 286; 204/207, 208, 272

[56] References Cited

U.S. PATENT DOCUMENTS

| | | | |
|---|---|---|---|
| 3,308,048 | 3/1967 | Olson | 204/272 |
| 3,526,115 | 9/1970 | Armstrong et al. | 72/45 |
| 3,620,853 | 11/1971 | Snyder et al. | 72/39 |
| 3,703,449 | 11/1972 | Farr et al. | 72/43 |
| 3,704,618 | 12/1972 | Cvacho et al. | 72/336 |
| 3,796,077 | 3/1974 | Swenson | 72/57 |
| 3,841,126 | 10/1974 | Minami et al. | 72/45 |
| 3,863,484 | 2/1975 | Tsuji et al. | 72/274 |
| 3,880,744 | 4/1975 | Idstein | 204/207 |
| 4,201,650 | 5/1980 | Nagano et al. | 204/272 |
| 4,232,541 | 11/1980 | Stump | 72/283 |
| 4,368,632 | 1/1983 | Trash et al. | 72/198 |
| 4,462,242 | 7/1984 | Morgenthaler | 72/467 |
| 4,528,079 | 7/1985 | Badger | 72/41 |
| 5,528,079 | 6/1996 | Badger | 204/129.1 |

*Primary Examiner*—Lowell A. Larson
*Assistant Examiner*—Rodney Butler
*Attorney, Agent, or Firm*—Thomas, Kayden, Horstemeyer & Risley

[57] ABSTRACT

A wire or rod drawing apparatus has a drawing die and a metallic tubular member through which the wire passes before entering the die. A D.C. voltage is applied between the rod and the tubular member for creating a voltage difference therebetween, and a lubricant is applied to the wire within the tubular member to function as an electrolyte.

4 Claims, 6 Drawing Sheets

REDUCTION OF FRICTION DURING WIRE DRAWING

RELATIONSHIP TO OTHER APPLICATIONS

This application is a continuation of U.S. patent application Ser. No. 08/199,850, filed Feb. 22, 1994, and now abandoned.

FIELD OF INVENTION

This invention relates to the drawing of materials through reducing dies, and, more particularly, to the drawing of metallic wire.

BACKGROUND OF THE INVENTION

In general, metallic wire, such as copper wire, is produced from rod stock by passing, i.e. pulling or drawing, the rod through a series of reducing dies, wherein each die produces an output rod or wire of lesser diameter than the input until the output of the final stage is wire of the desired diameter. In order that the drawing process be facilitated, the material being drawn, and also the dies, are heavily lubricated with a suitable lubricant to reduce friction. With proper lubrication the amount of pulling power needed and the concomitant incidence of wire breakage are reduced, and, generally, the overall quality of the wire is improved. As a consequence, much attention has been directed to apparatus and methods of achieving proper lubrication. In U.S. Pat. No. 3,526,115 of Armstrong et al, for example, there is shown a wire drawing arrangement and a method for lubricating the wire and dies to produce good quality wire, in which the wire is passed through a lubricant filled tubular chamber before entering the die. According to the disclosure of that patent, it was found that lubricant under high pressure within the chamber was more effective than lubricant under low or zero pressure.

Most metallic materials, most particularly copper, tend to oxidize fairly rapidly under the heat and humidity conditions generally encountered in the pre-drawing stages and the drawing process itself. Thus the surface of copper rod develops a thin layer or film of copper oxide even before being introduced into a die drawing apparatus.

SUMMARY OF THE INVENTION

The present invention, which is applicable to the drawing of a number of different materials, but will be described in terms of drawing copper, is an apparatus and method of reducing the frictional effects due to an oxide film on the copper rod and wire, thereby resulting in a decrease in required drawing or pulling power, a decrease in the incidence of wire breakage, and an improvement in the surface quality of the wire produced.

The basic apparatus of the invention, in a preferred embodiment thereof comprises a drawing stage having a single drawing die configuration, through which the copper rod or wire is passed from an upstream direction to a downstream direction. The wire entering the apparatus from upstream thereof is passed over one or more capstans into an elongated hollow metal tube located between the capstans and the drawing die. After exiting the downstream end of the tube the wire passes through the die over another capstan and proceeds to the next station or stage of the wire drawing apparatus which may be substantially the same as that described except for the die diameter. A suitable lubricant contained in a storage reservoir is sprayed upon the wire at the upstream capstans and at the entrance of the die. In addition, the hollow tubular member has lubricant supplied thereto. As thus far described, the apparatus is representative of the usual prior art drawing stage except for the presence of the hollow tube apparently shown only in the Armstrong et al. patent.

In accordance with the principles of the invention, a voltage is applied to the wire from a source of D.C. voltage, and to the hollow metal tube, so that a voltage difference exists between the wire and the tube. The voltage is applied to the wire by the application of voltage to one of the upstream capstans which may be made of copper, steel, or other conductive material. Alternatively, the voltage may be applied to the wire by a brush or sliding contact. Within the tube itself, the wire represents one electrode, the tube a second electrode, and the lubricant emulsion an electrolyte.

It has been found that this application of a voltage to the wire and the tube has a pronounced effect on the oxide skin or film existing on the wire, materially changing the amount and/or nature thereof, so that the frictional forces usually present as the wire passes through the die are substantially reduced. This reduction in friction results in a reduction in wire pulling power needed, and hence in a marked reduction in the frequency of wire breakage. An additional benefit is a greatly improved surface quality of the wire which is believed to be the result of several factors. Thus, the application of a negative voltage to the wire and a positive voltage to the tubular electrode across the electrolyte causes the copper oxide film to be reduced to oxygen and copper, with the oxygen going into suspension within the electrolyte, i.e., the lubricant. The voltage causes the H+ ions which exist in the lubricant due to the disassociation of the $H_2O$ to produce $H_2$ molecules in the form of gas at the surface of the copper, which has the effect of breaking the copper oxide off of the wire, that is, it "bubbles" the copper oxide off. Because there is less copper oxide film on the wire, the drawing die does not force as much copper oxide into the wire as is normally the case, hence the surface of the wire is more nearly pure copper rather than a mixture of copper and copper oxide. In other cases, application of the voltage changes the nature of the film in such a way that the pulling force is reduced.

The various features and advantages of the present invention will be more readily understood from the following detailed description, read in conjunction with the accompanying drawings.

DETAILED DESCRIPTION

Figure 1:
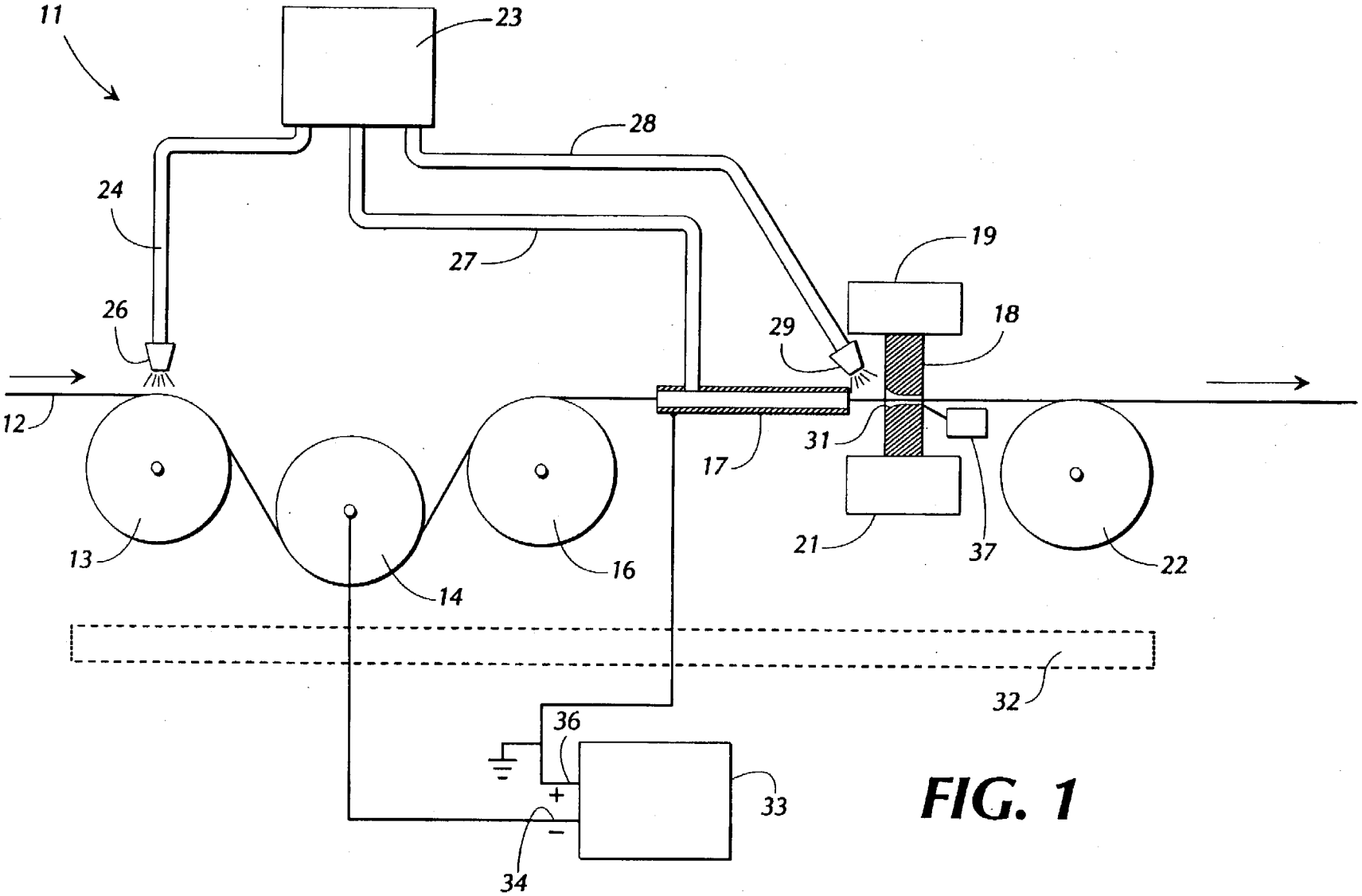
FIG. 1 is a diagrammatic view of an illustrative embodiment of the invention.

FIG. 1 is a diagrammatic representation of a single wire drawing stage which incorporates the principles of the invention. It is to be understood that, in practice, a plurality of such stages, with successively smaller dies arranged in tandem or series will generally be used.

A wire or rod 12 enters stage 11 in the direction of the arrow and passes over revolving capstans 13, 14 and 16, arrayed as shown, at least one of which, e.g. capstan 14, is powered. From capstan 16 the wire 12 passes through an elongated metallic tube 17 which extends between capstan 16 and a diamond drawing die 18, mounted in die holders 19 and 21. After passing through die 18 the wire passes over a capstan 22 to the next stage, not shown.

A lubricant supply reservoir 23 contains a suitable lubricant such as, for example, an emulsion of mineral or compounded oil and water wherein the suspended oil droplets are dispersed by means of a suitable emulsifier. Lubricant may be supplied, by pumping or other means, not shown, from reservoir 23 to the wire 12 through a conduit 24 and nozzle 26, which sprays lubricant on the wire 12 at capstan 13, as shown. Lubricant is also supplied through a conduit 27 to the interior of metallic tube 17 where, as will be apparent hereinafter, it functions as an electrolyte as well as a lubricant. A conduit 28 supplies lubricant through a nozzle 29 to both the wire 12 and the opening 31 in die 18. Excess or waste lubricant is captured by suitable means such as a catch basin 32, shown in dashed lines, from where it can be filtered and returned to reservoir 23. For simplicity, the pumping means, conduits, and any filter means have not been shown and it is to be understood that such components are standard, commercially available items.

In accordance with the principles of the invention, a source 33 of D.C. voltage has its negative terminal 34 connected to, for example, capstan 14, for applying a negative voltage to wire 12. The positive terminal 36 of source 33, which is grounded, as shown, is connected to tube 17. Thus, within tube 17, the wire 12 corresponds to a cathode and tube 17 to an anode, with the lubricant constituting an electrolyte. Such an arrangement has, as is well known, a corrosive effect on the metals, hence, tube 17 is preferably made of a non-corrosive or corrosion resistant electrically conductive material. Hence tube 17 may be made of stainless steel or copper with a platinum foil or platinum plated interior surface. Graphite or a platinized titanium or platinized niobium or platinized tantalum material might also be used. Such materials lessen the frequency with which the tube 17 must be replaced during operation due to the corrosive effects. Under certain laboratory conditions, e.g., the use of different lubricants, it has been found that a positive voltage on the wire produces the desired result of reducing pulling force.

Figure 2:
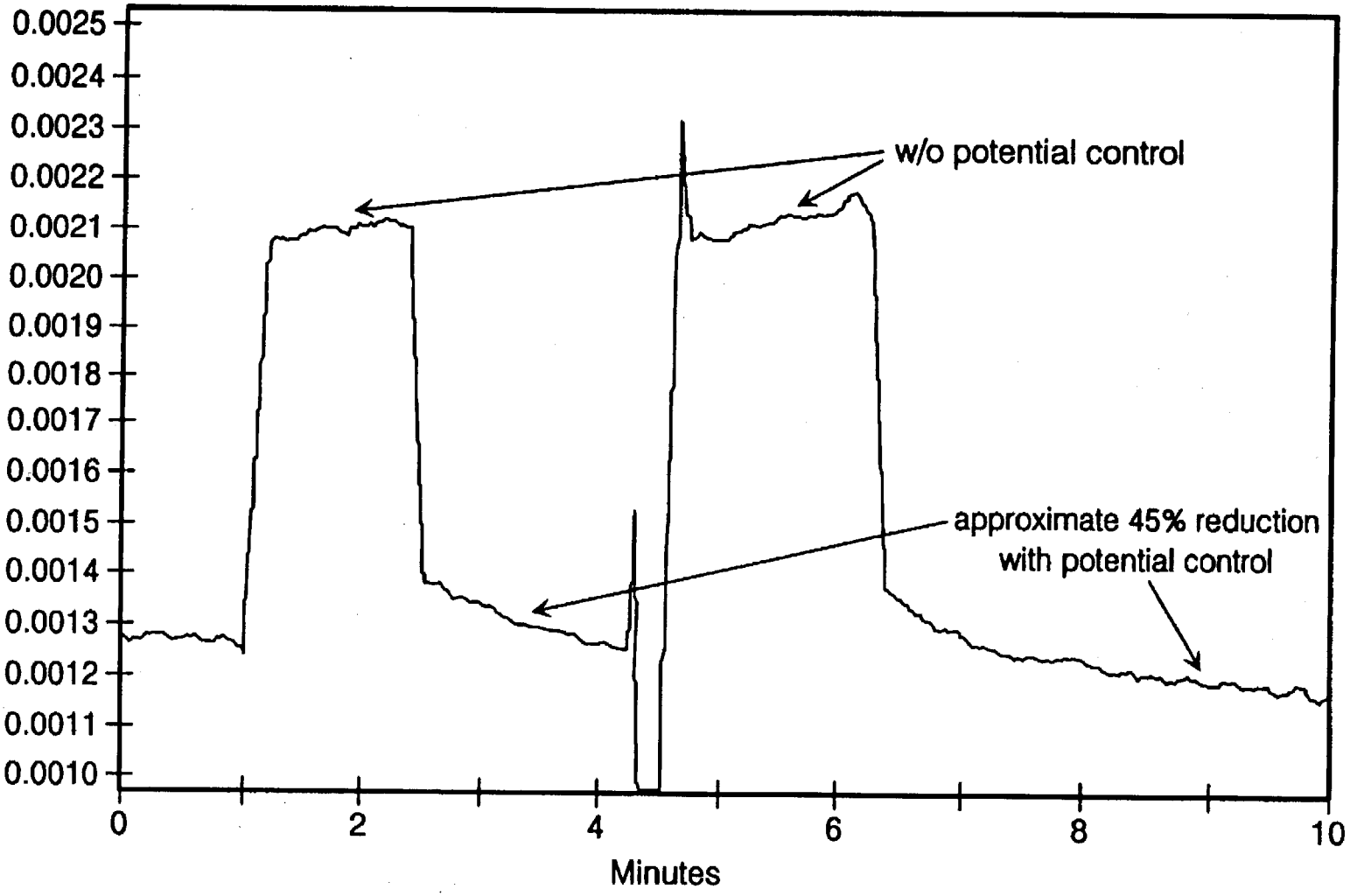
FIG. 2 is a graph of results obtained with the apparatus of FIG. 1.

With a drawing stage configured substantially the same as stage 11 of FIG. 1, and with a load cell 37 for measuring the pulling force on wire 12 at the die 18, results have been achieved which show a marked reduction in the pulling force, and hence the tension on wire 12, upon the application of a voltage to wire 12, with the interior wall of tube 17 at ground potential. In FIG. 2, there is shown a graph of the results of such operation, with the abscissa representing time and the ordinate representing voltage output of the load cell 37. The voltage output of load cell 37 is directly proportional to the tension, hence, the pulling force, on wire 12 as it is pulled through die 18 and indirectly, a function of the amount of oxide film on the wire. Such pulling force is, of course, a direct function of the friction between wire 12 and die 18. The results shown in FIG. 2 are the result of the application of approximately seventeen (17) volts negative to wire 12 with tube 17 grounded and can be interpreted as follows. With the voltage applied at zero (0) to one (1) minute, the output of load cell 37 was approximately twelve and one-half ten-thousandths (0.00125) volts. When the voltage was removed at one (1) minute, the output of load cell 37 immediately rose to approximately twenty-one ten-thousandths (0.0021) volts, thus indicating an almost seventy percent (70%) increase in friction between wire 12 and die 18. When the voltage was again applied, at approximately two and one-half (2½) minutes, the output of load cell 37 dropped substantially immediately to an average value of thirteen ten-thousandths (0.0013) volts where it remained until the voltage was again removed at approximately four and one-half (4½) minutes. (The spikes and dips shown at 4½ minutes are transients associated with the removal of the voltage). From 4½ minutes to approximately 6½ minutes the output of the load cell 37 was again high and, upon application of the voltage at approximately 6½ minutes, the output again dropped to the low value of twelve to thirteen ten-thousandths volts.

As indicated hereinbefore, the high voltage output from the load cell 37 indicates an increased friction, and the lower voltage output indicates a decreased friction, even though the lubricant was continuously supplied. Thus, the voltage or potential application is, apparently, independent of the use of a lubricant. This has apparently been born out of experiments in which distilled water, a poor lubricant, was used instead of a true lubricant. Results similar to those shown in FIG. 2 were obtained. Similar results have also been obtained using different applied voltages, from, for example, one (1) volt to forty-five (45) or more volts. The optimum voltage is dependent upon several factors, such as, for example, the material being drawn, the particular lubricant used, and the material and dimensions of the tube 17. Also, the polarity of the voltage depends upon the lubricant used, thus, for some lubricants, the wire 12 might have to be at a positive potential relative to tube 17 for best results.

Figure 3A:
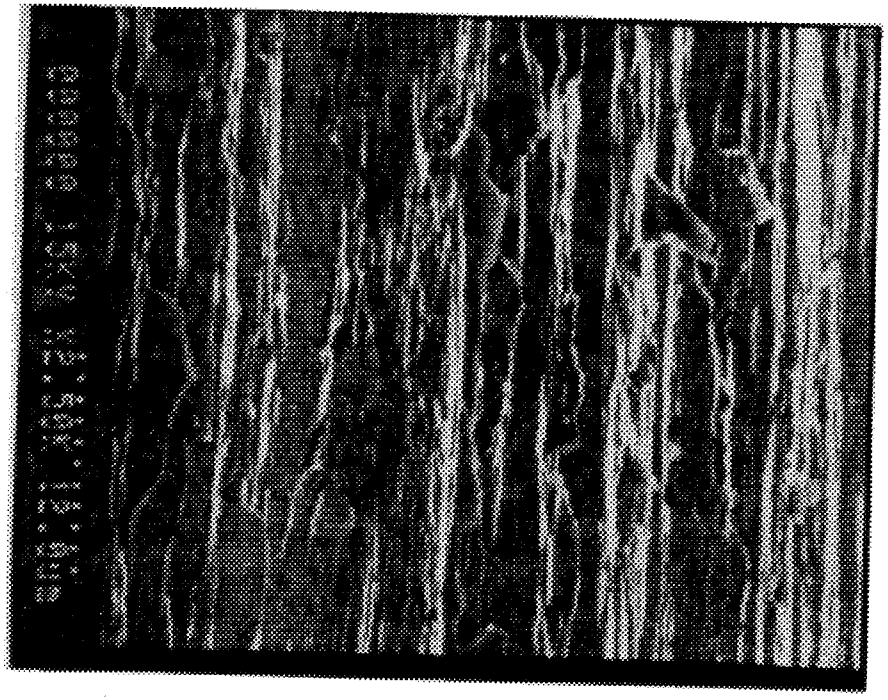
FIGS. 3A and 3B are electron microscope micrographs, of respectively, the surface of a wire drawn without utilizing the invention and a wire drawn using the invention; and, FIGS. 4A and 4B are electron microscope micrographs of the wire surfaces of FIGS. 3A and 3B at a greater magnification.
Figure 3B:
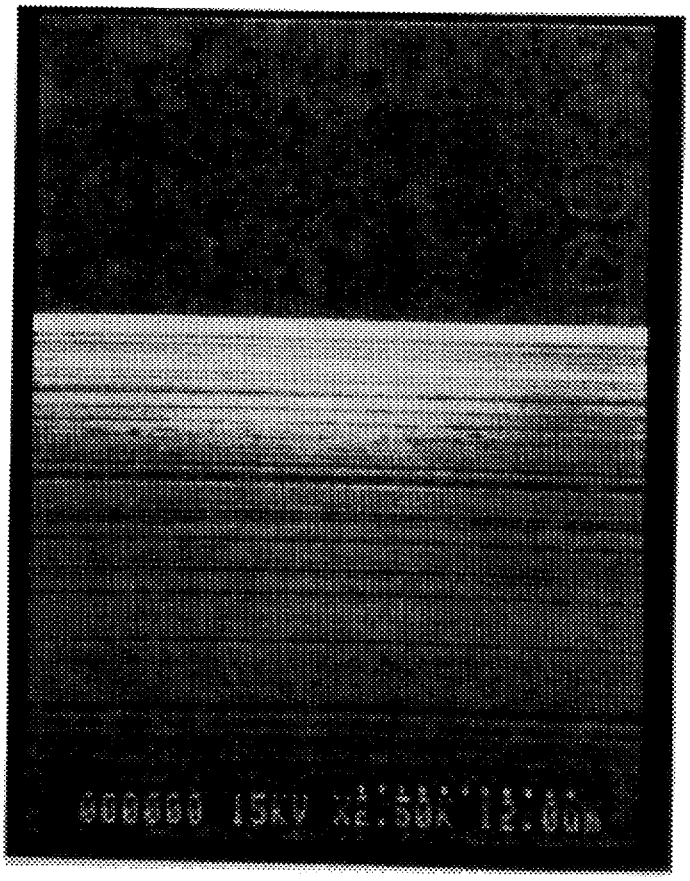
Figure 4A:
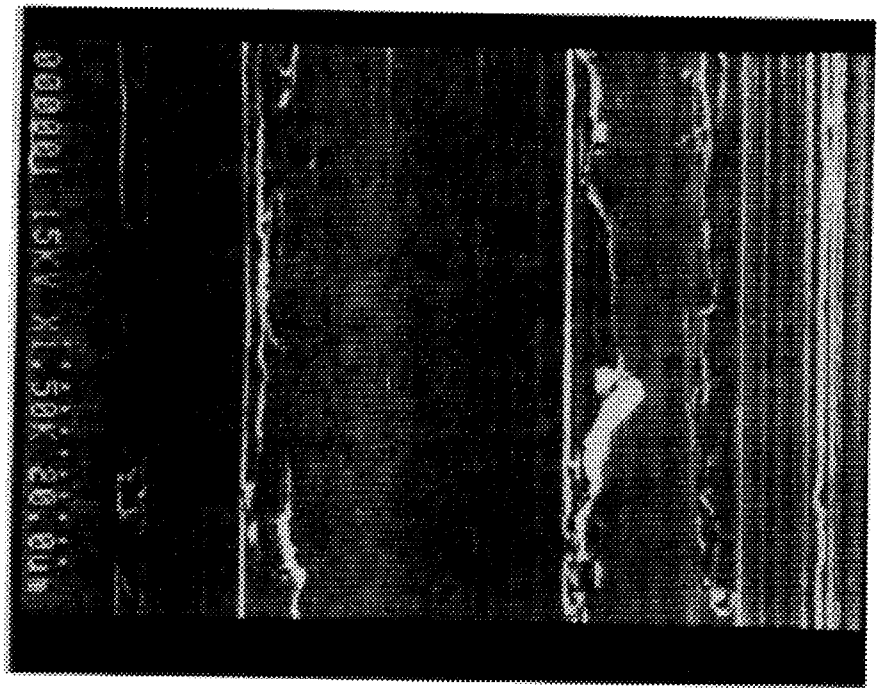
Figure 4B:
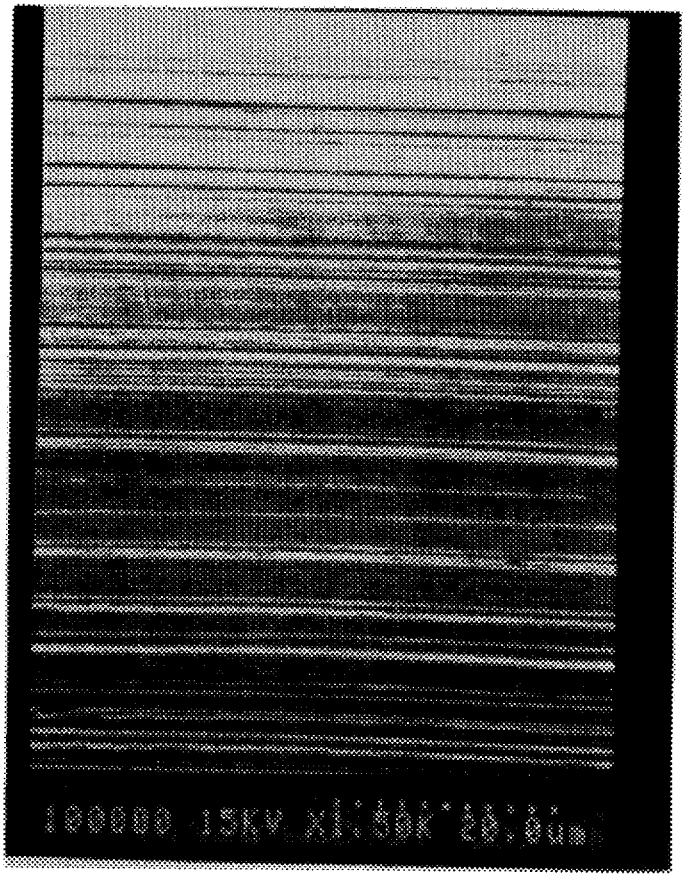

As was pointed out hereinbefore, the reduction in friction results from anode-cathode-electrolyte relationship within tube 17. This relationship functions to reduce or change the oxide film on the material being drawn, thereby reducing the pulling forces caused by friction and deformation within the die. Additionally, the surface quality of the drawn material, i.e., copper wire, is materially improved. In FIGS. 3A and 3B, which are scanning electron microscope micrographs, there are shown the results of wire drawing with and without an applied voltage. FIG. 3A shows the surface condition of a drawn wire using a drawing arrangement such as shown in FIG. 1 and without any applied voltage. It can be seen that the surface is extremely rough, primarily as a result of the oxide film both on and in the surface of the wire. FIG. 3B shows a similar view of the wire surface, where the wire was drawn with an applied potential. It can be seen that the surface is quite smooth and uniform as a result of the elimination of virtually all or at least a major portion of the oxide during the drawing operation. The improved surface shown in FIG. 3B is highly desirable in that there will be less friction in subsequent drawing stages, and that the oxide material is not incorporated into the wire which, consequently, is more nearly pure metal. When wire is used to transmit high frequency energy, the major portion of the energy is concentrated near the outer surface of the wire, a phenomenon known as skin effect. Thus, the wire of FIG. 3B has, for such transmission, less resistance and better overall transmission characteristics at high frequencies than the wire of FIG. 3A inasmuch as the resistivity at the surface is less, the oxide containing material having a higher resistivity than the pure metal. Similarly, FIGS. 4A and 4B show the drawn wire as viewed from the top, with greater magnification than for FIGS. 3A and 3B. The wire shown in FIG. 4A was drawn without potential control, and the wire of FIG. 4B was drawn with potential control. The improvement in the surface of the wire of FIG. 4B over that of the wire of FIG. 4A is readily apparent.

From the foregoing description of the preferred embodiment of the invention it can be seen that the invention produces drawn wire or the like that is materially improved over drawn wire produced by conventional drawing arrangements. This improvement is both manifest in the actual drawing operation wherein friction between the wire and the die and resistance to deformation are reduced, with a consequent reduction in required pulling power and wire breakage, and in the improved surface quality of the wire.

The principles of the invention have been disclosed in an illustrative embodiment thereof. Numerous variations or changes in the actual mechanism for realizing the advantages of the invention may occur to workers in the art without departure from these principles.

We claim:

1. A method of reducing the friction and required pulling power in a metallic wire drawing apparatus wherein the wire is pulled through a reducing die and wherein the wire has an oxide film on the surface thereof, said method comprising the steps of:

applying a voltage of a first polarity directly to the wire;

deoxidizing the surface of the wire by passing the wire through an electrolytic bath contained in a metallic container having a voltage of opposite polarity to said first polarity applied thereto;

pulling the deoxidized material through the reducing die; and determining the optimum voltage based upon the pulling force at the die.

2. The method as claimed in claim 1 and further including the step of applying an electrolyte to the metallic material prior to applying said voltage to the metallic material and as the metallic material enters the die.

3. The method as claimed in claim 1 wherein the step of deoxidizing the surface of the metallic material comprises applying a negative direct current voltage to the metallic material and applying a positive direct current voltage to the metallic container.

4. The method as claimed in claim 1 wherein the die comprises a diamond and the electrolyte comprise a lubricant suitable wire drawing operations.

* * * * *